US005909225A

United States Patent [19]

Schinnerer et al.

[11] Patent Number: 5,909,225

[45] Date of Patent: Jun. 1, 1999

[54] FRAME BUFFER CACHE FOR GRAPHICS APPLICATIONS

[75] Inventors: James A. Schinnerer, Fort Collins; Robert J. Martin, Timnath, both of Colo.

[73] Assignee: Hewlett-Packard Co., Palo Alto, Calif.

[21] Appl. No.: 08/866,694

[22] Filed: May 30, 1997

[51] Int. Cl.[6] ..... G09G 5/36

[52] U.S. Cl. ..... 345/509; 345/517; 345/518; 345/513; 345/521

[58] Field of Search ..... 345/507–509, 345/513, 518, 521, 196–198, 203, 517; 711/118, 127–131; 365/189.05, 189.08, 230.05, 230.08

[56] References Cited

U.S. PATENT DOCUMENTS

| | | | |
|---|---|---|---|
| 5,276,803 | 1/1994 | Iwase | 345/518 |
| 5,313,603 | 5/1994 | Takishima | 395/425 |
| 5,329,176 | 7/1994 | Miller, Jr. et al. | 307/443 |
| 5,424,996 | 6/1995 | Martin et al. | 365/233 |
| 5,598,526 | 1/1997 | Daniel et al. | 345/203 |
| 5,615,355 | 3/1997 | Wagner | 395/494 |
| 5,666,323 | 9/1997 | Zagar | 365/233 |
| 5,673,422 | 9/1997 | Kawai et al. | 345/519 |
| 5,696,945 | 12/1997 | Seiler et al. | 345/509 |
| 5,696,947 | 12/1997 | Johns et al. | 345/515 |
| 5,701,434 | 12/1997 | Nakagawa | 395/484 |
| 5,724,560 | 3/1998 | Johns et al. | 345/510 |
| 5,742,557 | 4/1998 | Gibbins et al. | 365/230.05 |
| 5,751,292 | 5/1998 | Emmot | 345/430 |
| 5,767,865 | 6/1998 | Inoue et al. | 345/519 |
| 5,787,457 | 7/1998 | Miller et al. | 711/105 |
| 5,808,630 | 9/1998 | Pannell | 345/509 |

*Primary Examiner*—Kee M. Tung

[57] ABSTRACT

A frame buffer cache includes a dual-input, dual-output storage cell to multiplex frame buffer tile data and pixel data. Tile data stored in one format while pixel data is stored in a second format. The cache allows for buffering the data in the two different formats so as to provide the data in the format as needed. Pixel data is retrieved from the tile data and file data is retrieved from the pixel data. The storage cell includes a multiple-bit latch and tri-state buffers which connect each storage cell to a tile data bus and a pixel data bus. A number of bus lines and components are reduced due to the use of the tri-state buffers.

23 Claims, 6 Drawing Sheets

FIG. 1
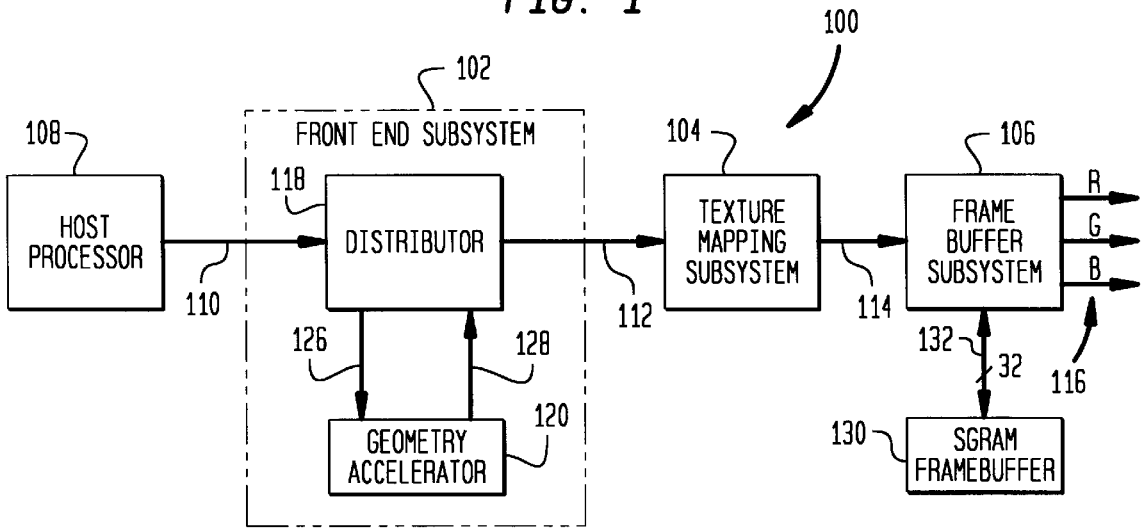
FIG. 2
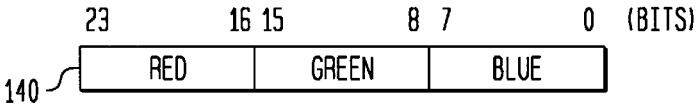
FIG. 3
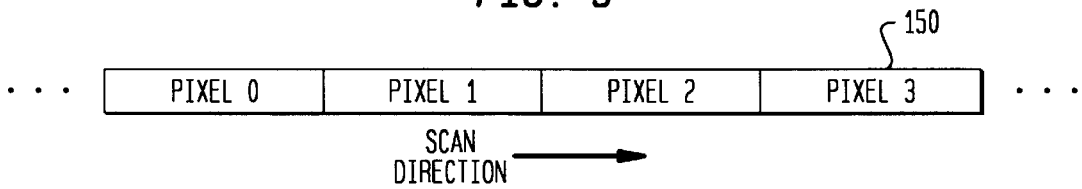
FIG. 4
| 32 24 | 23 16 | 15 8 | 7 0 (BITS) | |
|---|---|---|---|---|
| PIXEL 0 OVERLAY | PIXEL 1 OVERLAY | PIXEL 2 OVERLAY | PIXEL 3 OVERLAY | 160 |
| PIXEL 0 RED | PIXEL 1 RED | PIXEL 2 RED | PIXEL 3 RED | 162 |
| PIXEL 0 GREEN | PIXEL 1 GREEN | PIXEL 2 GREEN | PIXEL 3 GREEN | 164 |
| PIXEL 0 BLUE | PIXEL 1 BLUE | PIXEL 2 BLUE | PIXEL 3 BLUE | 166 |

FRAME BUFFER CACHE FOR GRAPHICS APPLICATIONS

BACKGROUND OF THE INVENTION

1. Field of The Invention

The present invention relates generally to computer graphics and animation systems and, more particularly, to graphics rendering hardware.

2. Related Art

Computer graphics systems are commonly used for displaying two- and three-dimensional graphics representations of objects on a two-dimensional video display screen. Current computer graphics systems provide highly detailed representations and are used in a variety of applications.

In a typical computer graphics system, an object or model to be represented on the display screen is broken down into graphics primitives. Primitives are basic components of a graphics display and may include, for example, points, lines, quadrilaterals, triangle strips and polygons. Typically, a hardware/software scheme is implemented to render, or draw, the graphics primitives that represent a view of one or more objects being represented on the display screen.

Generally, the primitives of the three-dimensional object to be rendered are defined by a host computer in terms of primitive data. For example, when the primitive is a triangle, the host computer may define the primitives in terms of the X, Y, Z and W coordinates of its vertices, as well as the red, green and blue and alpha (R, G, B and $\alpha$) color values of each vertex. Additional primitive data may be used in specific applications. Rendering hardware interpolates the primitive data to compute the display screen pixels that represent each primitive, and the R, G and B color values for each pixel. As an example, the color values for each pixel may be represented by eight bits each of R, G, B data for a total of twenty-four bits of data per pixel.

The basic components of a computer graphics system typically include a geometry accelerator, a rasterizer and a frame buffer. The system may also include other hardware, such as texture mapping hardware. The geometry accelerator receives from the host computer primitive data that defines the primitives that make up the model view to be displayed. The geometry accelerator performs transformations of coordinate systems on the primitive data and performs such functions as lighting, clipping and plane equation calculations for each primitive. The output of the geometry accelerator, referred to as rendering data, is used by the rasterizer and the texture mapping hardware to generate final screen coordinates and color data for each pixel in each primitive. The pixel data from the rasterizer and the pixel data from the texture mapping hardware, if available, are combined and stored in the frame buffer for display on the video display screen.

Previous frame buffer designs have used a two-port memory device with one port for supplying the rendering pixel data and the other for supplying data for screen refresh. The two ports on the memory device provided the necessary data bandwidth for maintaining system performance requirements. Two-port memory devices are expensive and in an attempt to reduce costs, have been replaced with high-speed single-port memory devices.

When, however, a single-port memory device is used in the frame buffer, memory bandwidth is divided between supplying pixel data for rendering and supplying data for screen refresh. Thus, it can be seen that the overhead operation time of screen refresh impacts rendering performance and if this refresh time can be reduced, performance will be increased.

Consider the case of a system with a single-port memory device where the single port is thirty-two bits wide and twenty-four bits of RGB data is provided for each pixel image along with an eight bit overlay buffer. As is known, in an X-Windows system, one image can be displayed in an overlay plane (about ¾ of the screen) and another image can be displayed in another plane (the remaining ¼ of the screen). The overlay buffer provides the data for representing the overlay image. Only one overlay byte is required for each overlay pixel value since this byte is mapped into a lookup table to determine the twenty-four bit color value for the pixel in the overlay plane. In other words, one of 256 possible twenty-four bit color values for each overlay pixel is determined by the overlay byte for that pixel. It is possible, therefore, to manipulate one image without affecting the other. Generally, the system will display the overlay buffer on ¾ of the screen (overlay plane) and an image represented with the twenty-four bit pixel data on the remaining ¼ of the screen. Thus, the frame buffer must supply data to a screen refresh unit (SRU) in both an eight bit format and a twenty-four bit format through the single-port of the memory device.

When, however, data is stored in the single-port memory device using the eight-bit format, access to every pixel would utilize only ¼ of the available bandwidth (8÷32). Further, if image data were stored in a twenty-four bit format, access to each pixel would still utilize only ¾ of the available memory bandwidth (24÷32). Under the best of circumstances, therefore, 25% of the memory device's bandwidth is unused.

Thus, there is a need for a method and apparatus for efficiently storing data in a single-port memory device which provides fast read/write access of the data to provide both rendering pixel data and screen refresh data so as to provide acceptable graphic performance. This device must be able to operate without complex control circuitry and without occupying large amounts of circuit area. Additionally, power consumption must be kept as low as possible.

SUMMARY OF THE INVENTION

The present invention provides for recovering the wasted bandwidth of the single-port memory device by packing the pixel data into 1×4 tiles. Four bytes of data, one byte for each of four adjacent pixels on a same scan line, are stored together in one thirty-two bit word of the single-port memory device. A dual-input, dual-output cache interfaces with the single port of the memory device to arrange the tile data received from the single-port memory into the twenty-four bit pixel data format necessary for rendering operations. Additionally, the cache receives data in the twenty-four bit pixel format and arranges the pixel data for output to the memory as tile data.

In one embodiment a cache for storing data in first and second formats, includes an array of storage elements organized in m rows and n columns; a first input bus coupled to said storage elements for coupling data in a first format into a selected row of said storage elements; a first output bus coupled to said storage elements for coupling data in said first format from said selected row of said storage elements; a second input bus coupled to said storage elements for coupling data in a second format into a selected column of said storage elements; and a second output bus coupled to said storage elements for coupling data in said second format from said selected column of said storage elements.

In a second embodiment, a dual input, dual output n-bit storage cell, having first and second input data buses and first and second output data buses, includes a latch having a latch input bus and a latch output bus; a first input buffer connected between the first input data bus and the latch input bus to operatively couple the first input data bus to the latch input bus; a second input buffer connected between the second input data bus and the latch input bus to operatively couple the second input data bus to the latch input bus; a first output buffer connected between the latch output bus and the first output data bus to operatively couple the latch output bus to the first output data bus; and a second output buffer connected between the latch output bus and the second output data bus to operatively couple the latch output bus to the second output data bus.

A method embodiment of storing and providing data in first and second formats in an apparatus having a plurality of storage devices connected in a multiple row and multiple column configuration, each storage device having first and second inputs connected, respectively, to first and second input buses and having first and second outputs connected, respectively, to first and second output buses, includes steps of: providing input data in the first format on the first input bus; storing a respective segment of the input data in a respective storage device in a row; outputting the data in each storage device in each column to the second output bus.

A graphics system, for processing and storing pixel data in a first format and tile data in a second format, includes a memory for storing the tile data in the second format including a bi-directional port; a cache for storing pixel data in said first format and for storing tile data read from said memory in said second format, said cache comprising an array of storage elements organized in m rows and n columns; and a controller for coupling pixel data in said first format to and from a selected row of said storage elements in said cache and for coupling tile data in said second format to and from a selected column of said storage elements.

Further features and advantages of the present invention as well as the structure and operation of various embodiments of the present invention are described in detail below with reference to the accompanying drawings. In the drawings, like reference numerals indicate like or functionally similar elements.

BRIEF DESCRIPTION OF THE DRAWINGS

This invention is pointed out with particularity in the appended claims. The above and further advantages of this invention may be better understood by referring to the following description when taken in conjunction with the accompanying drawings, in which:

FIG. 1 is a block diagram of an exemplary computer graphics system including a frame buffer subsystem;

FIG. 2 is a representation of twenty-four bits of R, G, B pixel data;

FIG. 3 is a representation of four pixels in a scan line;

FIG. 4 is a representation of tile data stored in a frame buffer;

DETAILED DESCRIPTION

Graphics System

Figure 5:
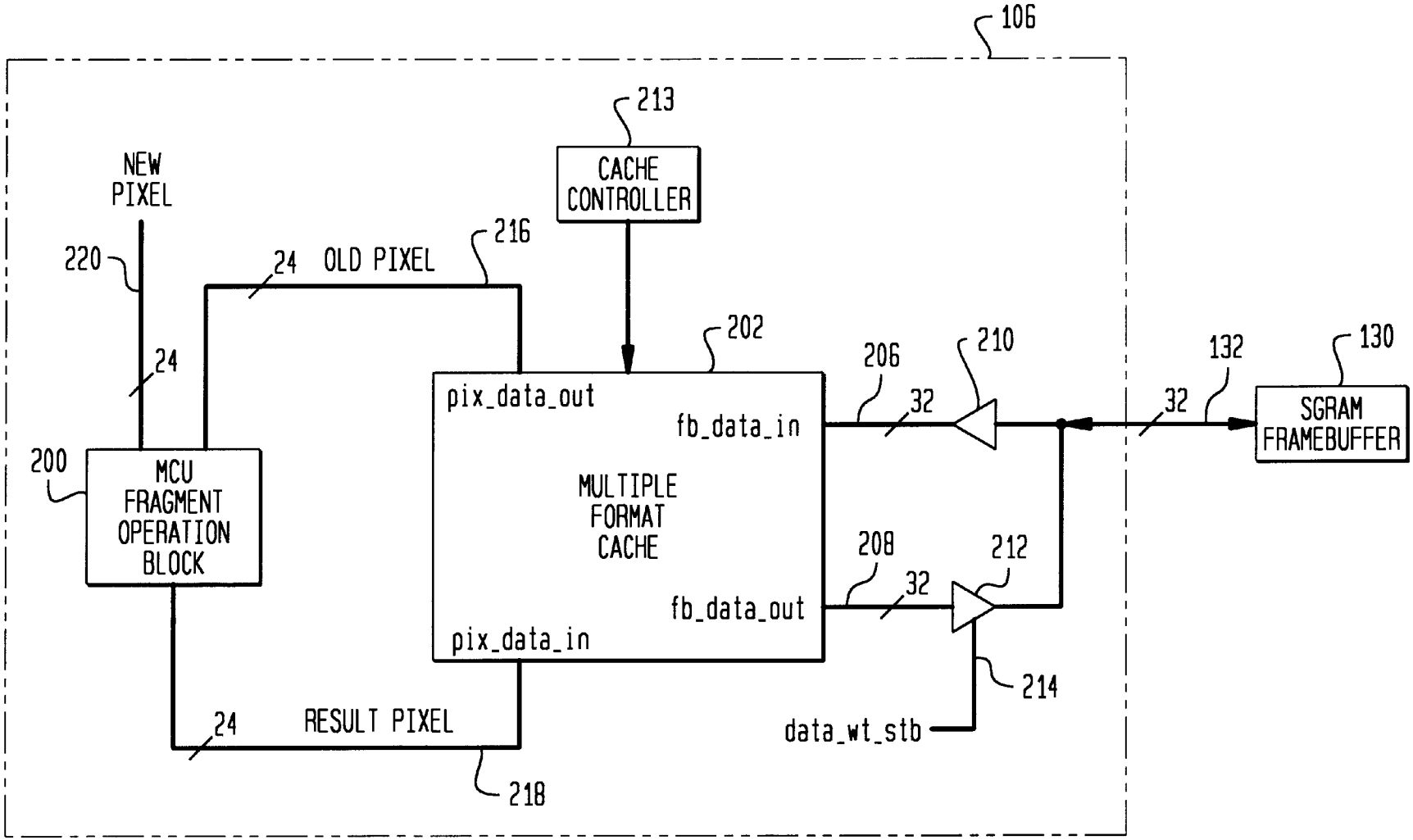
FIG. 5 is a block diagram of the frame buffer subsystem.

FIG. 1 is a block diagram of an exemplary computer graphics system 100. As shown, the system 100 includes a front-end subsystem 102, a texture mapping subsystem 104 and a frame buffer subsystem 106. The front-end subsystem 102 receives primitives to be rendered from the host computer 108 over bus 110. The primitives are typically specified by X, Y, Z and W coordinate data, R, G, B and $\alpha$ color data and texture S, T, R and Q coordinates for portions of the primitives, such as vertices.

Rendering data representing the primitives in a three-dimensional image is provided by the front-end subsystem 102 to the frame buffer subsystem 106 over bus 112 to an optional texture mapping subsystem 104. The texture mapping subsystem 104 interpolates the received primitive data to provide values from stored texture maps to the frame buffer subsystem 106 over one or more buses 114.

The frame buffer subsystem 106 interpolates the primitive data received from the front-end subsystem 102 to compute the pixels on a display screen (not shown) that will represent each primitive, and to determine object color values and Z values for each pixel. The frame buffer subsystem 106 combines, on a pixel-by-pixel basis, the object color values with the resulting texture data provided from the optional texture mapping subsystem 104, to generate resulting image R, G and B values for each pixel. R, G and B color control signals for each pixel are respectively provided over R, G and B lines 116 to control the pixels of the display screen to display a resulting image on the display screen that represents the texture-mapped primitive. As shown in FIG. 2, the color values for each pixel may consist of eight bits each of R, G, B data 140 for a total of twenty-four bits per pixel.

The front-end subsystem 102 includes a distributor 118 and a three-dimensional geometry accelerator 120. As noted, the distributor 118 receives the coordinate and other primitive data over bus 110 from a graphics application on the host processor 108. The distributor 118 dynamically allocates the primitive data to the geometry accelerator 120.

Primitive data, including vertex state (coordinate) and property state (color, lighting, etc.) data, is provided over bus 126 to the geometry accelerator 120. The geometry accelerator 120 performs well-known geometry accelerator functions which result in rendering data for the frame buffer subsystem 106. Rendering data generated by the geometry accelerator 120 is provided over output bus 128 to distributor 118. Distributor 118 reformats the primitive output data (that is, rendering data) received from the geometry accelerator 120, performs a floating point to fixed point conversion, and provides the primitive data stream over bus 112 to the optional texture-mapping subsystem 104 and subsequently to the frame buffer subsystem 106.

The frame buffer subsystem 106 is connected to a Synchronous Graphics Random Access Memory (SGRAM) frame buffer 130. The SGRAM frame buffer 130 is a single port memory device with the single port being thirty-two bits wide. Thus, the frame buffer subsystem 106 is connected to the SGRAM frame buffer 130 through a thirty-two bit bus 132.

Since the SGRAM frame buffer 130 is a single port device, memory bandwidth is used both for rendering pixel data to the SGRAM frame buffer 130 and for reading the SGRAM data for display to the display screen.

As is known, a scan line in a display includes a plurality of pixels. Four adjacent pixels (pixel0, pixel1, pixel2 and pixel3) as found in a scan line 150 are shown in FIG. 3. Each of these pixels is defined by, for example, twenty-four bits of red, green and blue data (eight bits each).

In the system of FIG. 1, the wasted bandwidth of the single-port SGRAM frame buffer 130 is recovered by packing the pixel data into 1×4 tiles, i.e., byte components (red, green, blue, etc.) of four adjacent pixels (pixel0–pixel3) on the same scan line are stored together in each single thirty-two bit word within the SGRAM frame buffer 130. As shown in FIG. 4, one thirty-two bit word 160 stores four, eight bit overlay pixels for pixels0–3. A next thirty-two bit word 162 stores the eight bit red data for each of the four pixels. Additional thirty-two bit words 164, 166 store the green and blue data, respectively, for each of the four pixels. When displaying the overlay data, instead of reading four thirty-two bit words, only one word is read. When displaying twenty-four-bit image data, i.e., red, green and blue, only three reads are required instead of four. This recovered bandwidth directly increases the pixel rendering performance.

While the foregoing memory organization provides improved bandwidth efficiency, this memory organization is not desirable for rendering three-dimensional images. For example, in a case of a blending operation, where new source pixel data is "blended" or combined with the pixel data for the pixel that is already being displayed, the old pixel data must be retrieved from the frame buffer. In a simple case of blending one twenty-four bit pixel, for example pixel0, the old or displayed data is read from the SGRAM frame buffer 130 in three separate reads, i.e., one each for the three color components, red, green and blue of pixel0. The old pixel data thus arrives in three different parts, at three different times and, therefore, must be stored locally since the blending operation cannot be started until all data for pixel0 is available. Once all three color components are loaded, the desired twenty-four bits are presented to the blender along with the new twenty-four bits of pixel color data. The result of the blend operation is then stored locally and is then written back out to the SGRAM frame buffer 130 again using three write operations.

The present invention provides a frame buffer cache for handling both pixel formatted data (twenty-four bits) and tile formatted data (thirty-two bits). Data operations, such as blending, involving the SGRAM frame buffer 130 are implemented efficiently for three-dimensional images since the pixel data is represented in the format needed for rendering and then in the format for storage in the SGRAM frame buffer 130.

The frame buffer subsystem 106 includes, as shown in FIG. 5, a memory control unit (MCU) fragment operation block 200 to carry out the blending function, among other functions, connected to a multiple format cache 202. The cache 202 has a thirty-two bit frame buffer input bus fb_data_in 206 and a thirty-two bit frame buffer data output bus fb_data_out 208. These frame buffer buses 206, 208, respectively, receive data from and transmit data to the SGRAM frame buffer 130 over the SGRAM bus 132, and are operatively coupled to the single port 132 of the SGRAM frame buffer 130 via buffers 210, 212, respectively. The output buffer 212 is controlled by a data write strobe line 214 to control data output by the cache 202 on to the bus 132 of the SGRAM frame buffer 130. A cache controller 213 provides control signals to the cache 202 so as to provide the appropriate data to and from the MCU fragment operation block 200 and the SGRAM frame buffer 130.

The MCU fragment operation block 200 receives new pixel data via a twenty-four bit bus 220 and receives old pixel data from the cache 202 via a twenty-four-bit pix_data_out bus 216. The old pixel data and new pixel data are "blended" together and result pixel data is sent from the MCU fragment operation block 200 to the cache 202 via a twenty-four bit pix_data_in bus 218. The cache 202, therefore, provides local storage for the MCU fragment operation block 200. Data is written to and from the SGRAM frame buffer 130 in a thirty-two bit wide tile format. Data is also written to and from the MCU fragment operation block 200 in a twenty-four bit pixel format for fragment operations such as the blending operation.

Figure 6:
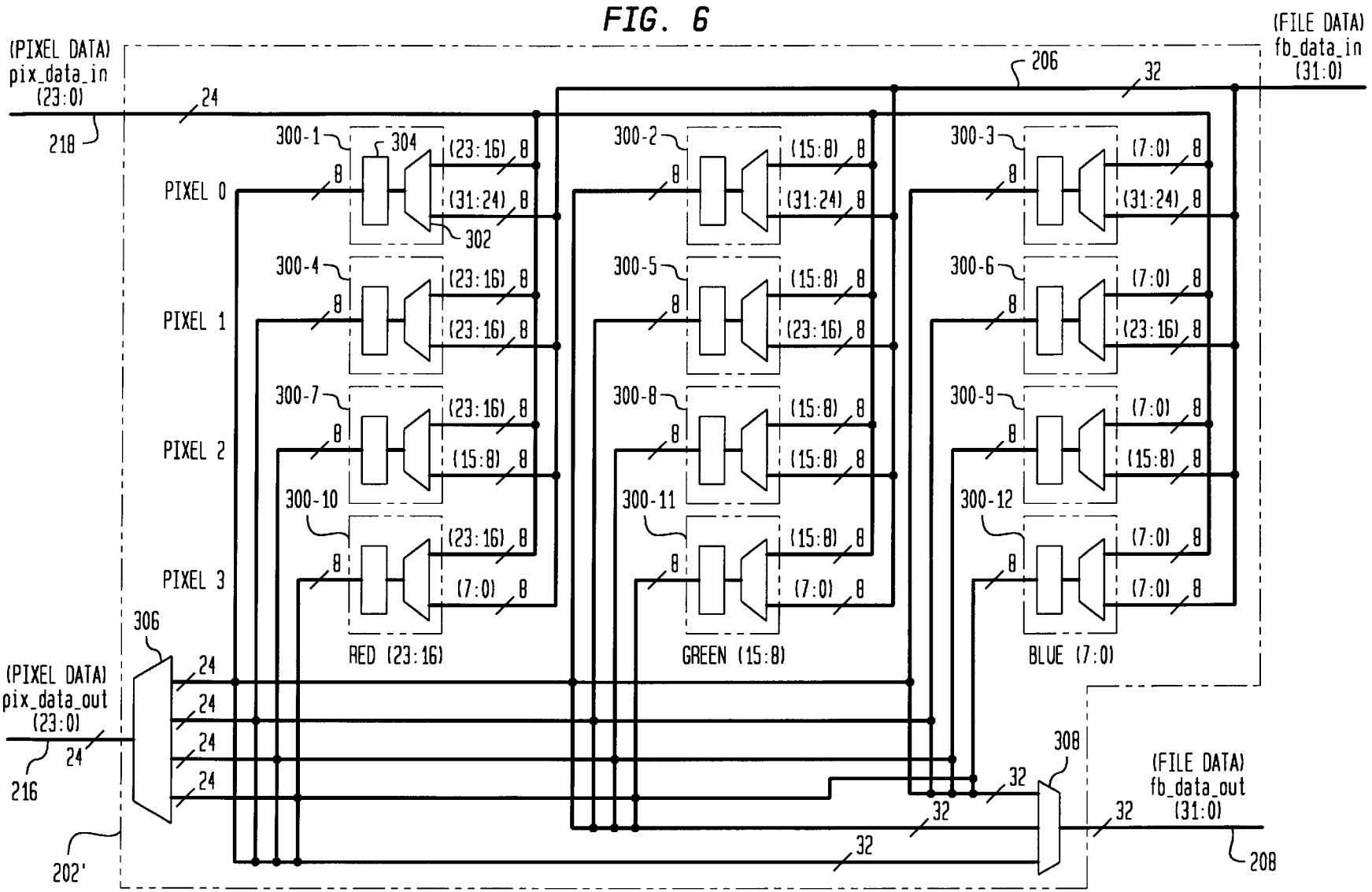
FIG. 6 is a block diagram of one embodiment of a multiple format cache.

One embodiment of a multiple format cache 202' is shown in FIG. 6. Twelve, eight-bit storage elements 300 are functionally arranged in rows and columns with three storage elements in each row and four storage elements in each column. Each column of four represents a single color component, i.e., red, green or blue data of the four pixels in the tile. Each row represents the red, green and blue data for a single pixel in the tile. The twelve storage elements, therefore, together represent the four pixels contained in the tile. It should be noted that control signals have been omitted for clarity. Each storage element 300 includes an eight-bit, 2:1 multiplexer 302 and an eight-bit latch 304.

Outputs of each of the storage elements 300 are connected to a twenty-four bit, 4:1 multiplexer 306 to provide output pixel data and to a thirty-two bit, 3:1 multiplexer 308 to provide frame buffer (tile) data. As can be seen, the cache 202' is configured in a row by column configuration of storage elements 300 with each row representing pixel data for one pixel and each column representing a single color's data for all pixels in the tile. Thus, the storage elements 300-1, 300-2 and 300-3 in the first row combine to provide twenty-four bits of red, green and blue data for pixel0 to a first input of the multiplexer 306 while the four storage elements 300-1, 300-4, 300-7 and 300-10 combine to provide thirty-two bits of red data for pixels0–3 to a first input of the multiplexer 308.

In operation, thirty-two bit frame buffer (tile) data is written to a desired column of storage elements 300 via input data bus fb_data_in 206 which is operatively coupled to the SGRAM frame buffer 130, as shown in FIG. 5. For example, the red data for all four pixels in the tile set on input bus fb_data_in 206 would be written to the "red" column consisting of storage elements 300-1, 300-4, 300-7, 300-10 by configuring the control signals appropriately. The green and blue data would then be placed on the input bus fb_data_in 206 and written to the respective column. It is possible that data placed on the fb_data_in bus 206 could be set in all three columns at once by enabling the storage elements appropriately.

Once all three color components for the tile are written from the SGRAM frame buffer 130 to the cache 202', the image data can be read from the cache in the twenty-four bit RGB pixel format which is required for blending. The pixel being read is selected by the multiplexer 306 and the data is sent out on the twenty-four bit bus, pix_data_out 216. For example, the data for pixel0 is selected when the multiplexer 306 selects the twenty-four bits of data coming from storage elements 300-1, 300-2, 300-3 in the "pixel0" row.

Pixel data is written to the cache 202' via the twenty-four bit input bus pix_data_in 218. It should be noted that all pixels are written via this same input bus and that the same pixel data can be input for one or more pixels at the same time. In other words, if, for example, pixel0 and pixel1 are the same color, i.e., the same twenty-four bits of data, then these two rows of storage elements can be set at the same time. Further, all four rows of storage elements could be provided with the same data at the same time. This is a convenient operation when all four pixels in the tile are the same color, for example, in a "fill" operation.

Once all pixel data for the pixels in a given tile are written to the cache 202', the image data is written out to the SGRAM frame buffer 130 in the tile format through the output bus fb_data_out 208. The particular color being read for the pixels in the tile is selected by the multiplexer 308. For instance, the outputs of the storage elements 300-2, 300-5, 300-8, 300-11 combine to provide the thirty-two bits of green tile data for the four pixels in the tile.

In summary, the pixel data (red, green, blue) is written into the cache 202' in a row operation with one row per pixel. As above, more than one row (pixel) can be set with the same data at the same time. Once all of the pixel data is set into the cache, the tile data is read out in a column operation with each column representing a single color's data for all pixels in the tile. In the opposite direction, the tile data is read from the SGRAM frame buffer 130 into the cache 202' in a column operation, one column per color. After all tile data is read into the cache 202', the pixel data (red, green, blue) for each pixel is read out on a row by row basis with one row per pixel.

When a pixel depth of more than twenty-four bits is desired, additional storage can be added by connecting more columns of storage cells 300. As an example, a cache for a twenty-four bit depth buffer would double the required storage. In addition, further output multiplexing would be required to handle the added pixel information, i.e., an additional twenty-four bit, 4:1 multiplexer would be necessary to create the output bus for depth data (not shown).

While the cache 202' as shown in FIG. 6 is useful for explaining its functions and might be simple to build, it does, however, occupy a large amount of chip area due to the line routing requirements. As an example, with twenty-four bits per pixel, for this single tile RGB cache 202', there are ninety-six data lines routed to the output multiplexers 306, 308. This might be acceptable for a very small cache, but if each cache in an apparatus were to store sixty bits per pixel, e.g., four bits of data stencil, twenty-four bits for depth data and thirty-two bits for $\alpha$ and RGB, there would be 240 data lines routed to each of the output multiplexers 306, 308, thus increasing routing complexity and increasing the extra area required by the storage cells. Further, if a cache were to store four tiles (sixteen pixels), instead of one tile, there would be 960 data lines routed to the output multiplexers 306, 308 which is a 4× increase in routing complexity thus scaling linearly as the number of tiles increases. Routing complexity severely impacts circuit area especially where there are multiple memory controllers having multiple pixel caches associated therewith.

Figure 7:
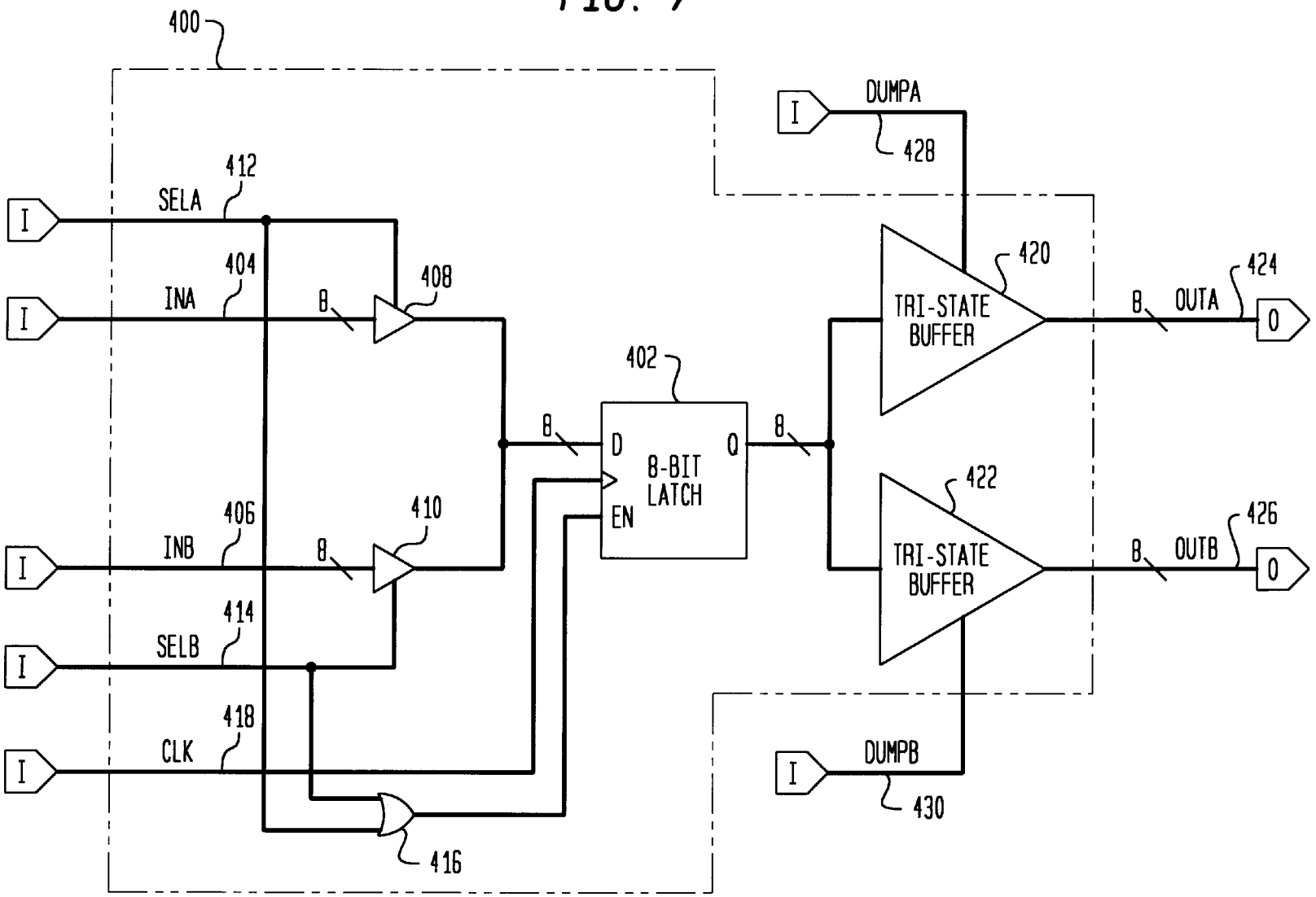
FIG. 7 is a block diagram of a two-input, two-output storage cell according to the present invention.

To solve the routing complexity problems of the cache 202', a unique storage element 400 is provided as shown in FIG. 7. An eight-bit latch 402 is operatively coupled to two eight-bit inputs INA 404 and INB 406. The eight-bit input INA 404 is connected to the eight-bit latch 402 by an eight-bit buffer 408. Similarly, the other eight-bit input INB 406 is connected to the eight-bit latch by another eight-bit buffer 410. The eight-bit buffers 408, 410 are selected, respectively, by select lines SELA 412 and SELB 414. It should be noted that the cache controller 213 controlling select lines SELA, SELB 412, 414 must guarantee that only one select line per storage cell is asserted at a time.

An OR-gate 416 has two inputs connected to the SELA line 412 and SELB line 414 and an output connected to an enabling terminal of the eight-bit latch 402. A clock signal 418 is provided to the eight-bit latch 402. Thus, assertion of either select line SELA line 412 or SELB line 414 enables the eight-bit latch 402 to store the data presented at the output of, respectively, the buffers 408, 410. It is also to be noted that input buffers 408, 410 can be tri-state devices although they still cannot be selected at the same time.

The eight-bit latch 402 provides an eight-bit output to each of two eight-bit output buffers 420, 422. The output of the eight-bit buffer 420 is connected to an eight-bit output bus OUTA 424. The output of the eight-bit output buffer 422 is connected to an eight-bit output bus OUTB 426. The output buffer 420 is controlled by a dump line DUMPA 428, while the output buffer 422 is controlled by a dump line DUMPB 430. Each of the output buffers 420, 422 are tri-state devices, and both can be enabled simultaneously. In other words, the signals DUMPA 428 and DUMPB 430 can be asserted at the same time. As can be seen, data presented on the input INA 404 can be latched in the latch 402 and output on either (or both) of outputs OUTA 424 and OUTB 426. Similarly, data presented in the input INB can be latched in the latch 402 and output on either (or both) of outputs OUTA 424 and OUTB 426.

Using the storage cell 400, a single tile RGB cache can be fabricated which functions equivalently to that as described with regard to FIG. 6 but which has much less complex routing requirements. A single tile RGB cache 500 using the storage cell 400 is shown in FIG. 8.

The single tile RGB cache 500 includes twelve storage cells 400 arranged in a row, column configuration of three storage cells by four storage cells. All multiplexing functions are now handled by the tri-state output buffers 420, 422 in each of the storage cells 400. The use of tri-state buffers 420, 422 allows the output buses pix_data_out 216 and fb_data_out 208 to be connected to the outputs of all of the storage cells directly, thus eliminating the need to route the data from each cell 400 to centrally located multiplexers such as multiplexers 306, 308 as shown in FIG. 6. The output requirements of the single tile RGB cache 500 are now met by routing only fifty-six data lines, i.e., thirty-two bits for the tile data and twenty-four bits for the pixel data.

The advantages of the storage cell 400 become clear by considering the number of data lines which are required to store sixty bits per pixel. A single tile pixel cache with sixty bits per pixel would require only ninety-two data lines to be routed for the output, i.e., sixty lines for pixel data and thirty-two lines for frame buffer data. This is compared to the single tile cache as shown in FIG. 6 which, with sixty bits per pixel, would have required 240 data lines to be routed to the output multiplexers 306, 308. Thus, the single tile RGB cache 500 scales very well with pixel depth. Further, if the single tile RGB cache 500 were adapted to store four tiles of data, the same ninety-two data lines would be used, and the additional storage cells would not require additional lines to be routed. This is in comparison to the architecture shown in FIG. 6 which, as already explained, would require 960 data lines to be routed to the output multiplexers 306, 308 for four tiles.

Figure 8:
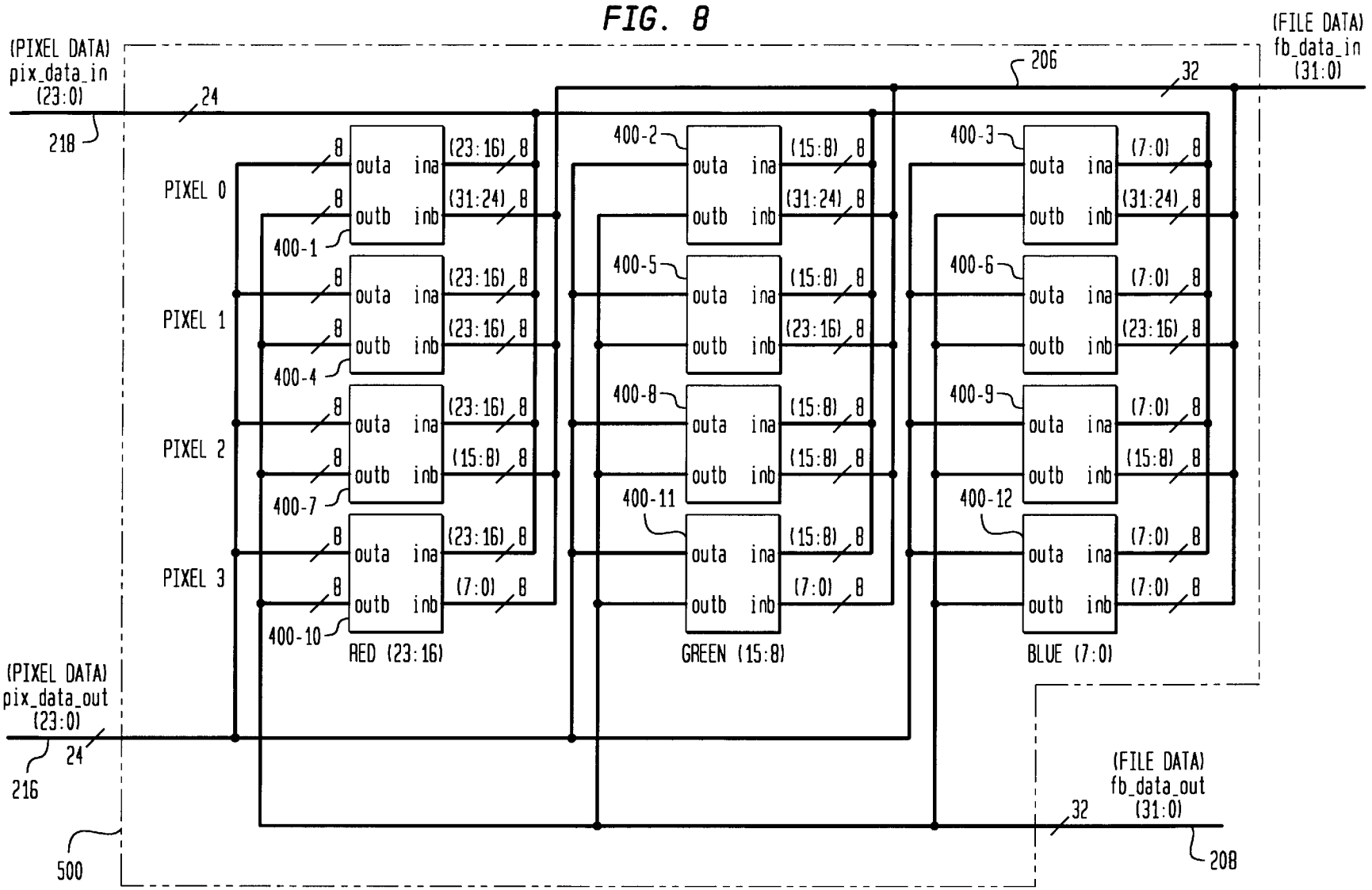
FIG. 8 is a block diagram of a second embodiment of a multiple format cache implemented with the storage cells of FIG. 7.
Figure 9:
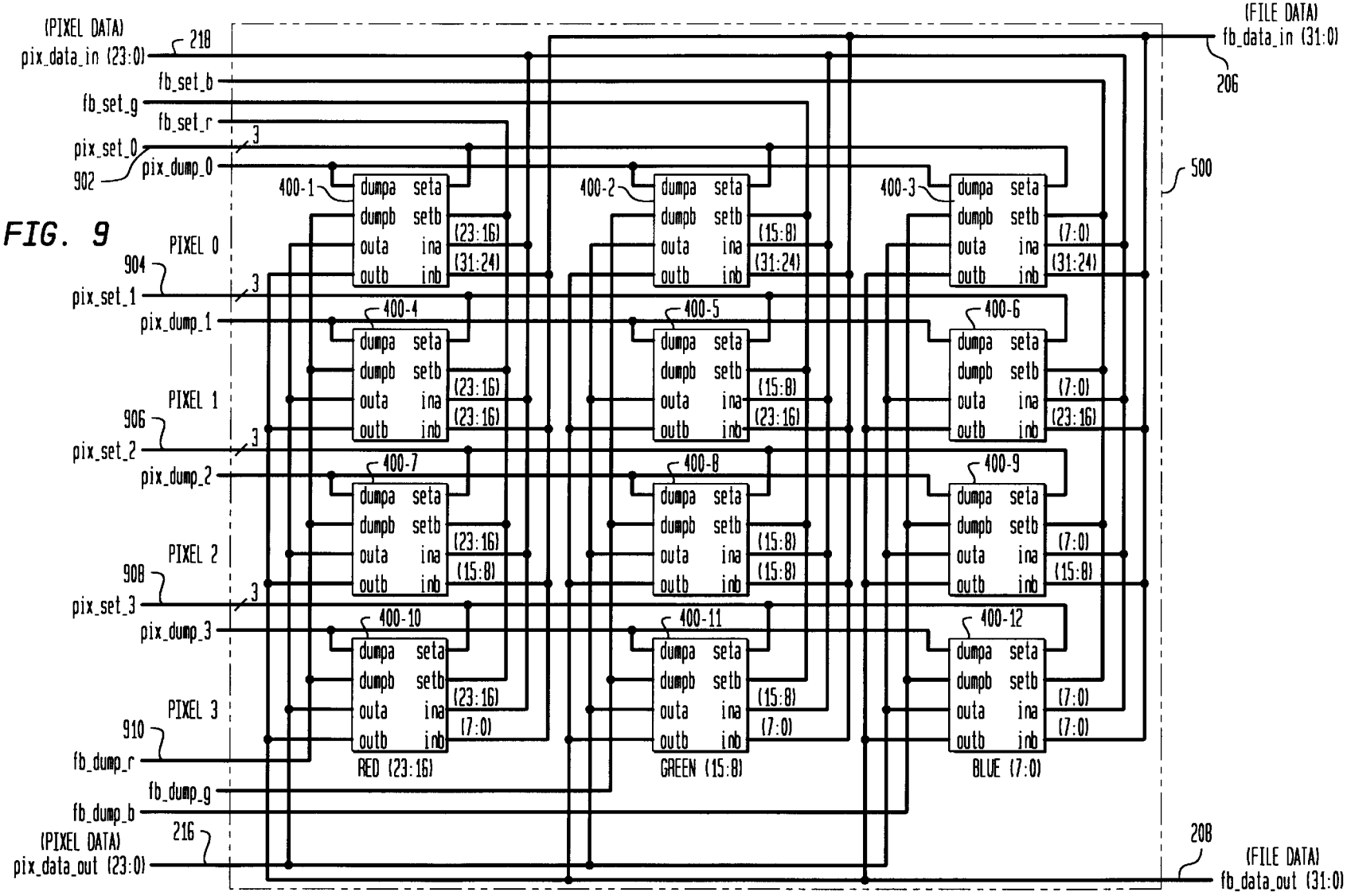
FIG. 9 is a block diagram of the multiple format cache of FIG. 8 including the control lines.

The single tile RGB cache 500 in FIG. 8, for the sake of clarity, was shown without control lines. The control lines are shown in FIG. 9. As can be seen, the control lines are set to input and output pixel data in a row operation, while the tile data is input and output in a column operation. A control line bus pix_set0 902, consisting of three bits, is connected to the SELA select lines of the storage cells 400-1, 400-2, 400-3 which hold, respectively, the eight bits of red, green and blue data for pixel0. In operation, the RGB data for pixel0 is placed on pix_data_in input bus 218, and all three bits of the control line bus pix_set0 are enabled. The data is then stored in the three storage cells 400-1, 400-2, 400-3 . In a similar fashion, the RGB data for the remaining pixels, pixel1–pixel3, is stored by placing the appropriate data on the pix_data_in input bus 218 and enabling all three lines of the respective pix_set1–3 control line buses 904, 906, 908.

With the control line buses pix_set0, pix_set1, pix_set2, pix_set3, individual storage cells 400 in a given pixel row can be set. For instance, to set only the green data in pixel0, only the line in control line bus pix_set0 connected to storage cell 400-2 would be asserted, and the other two lines connected to storage cells 400-1, 400-3 would not be asserted. As an additional feature, the states of the lines in the control line buses pix_set0–3 can be monitored to determine when the data in the cache should be sent to the SGRAM frame buffer 130. Whenever at least one of the lines in the control line buses is asserted, it indicates that new pixel data has been written to the cache and new tile data should be sent to the SGRAM frame buffer 130. If none of the lines in the control line buses are asserted, no tile data need be sent to the SGRAM frame buffer 130.

The tile data is provided to the SGRAM frame buffer 130 by asserting, as an example, for the red data, an fb_dump_r line 910 connected to the DUMPB inputs of the four storage cells 400-1, 400-4, 400-7, 400-10 in the "RED" column. This will then place thirty-two bits of red data for the four pixels in the tile on the fb_data_out output bus 208. The timing of the control lines for retrieval of tile data from the SGRAM frame buffer 130 and its placement into the appropriate storage cells can easily be determined by one of ordinary skill in the art and is not discussed herein. In addition, the timing of control lines for providing pixel data to the MCU fragment operation block 200 can easily be determined and is also not discussed herein.

As noted before, the cache controller 213 must guarantee that only one input enable line is asserted at a time. Further, in normal operation, the cache cannot be written through both input buses fb_data_in 206 and pix_data_in 218 simultaneously. For any given storage cell 400, the new pixel data is given priority over the old data from the frame buffer. In a preferred embodiment, the cache controller 213 also keeps track of which storage cells have been written with old frame buffer data as well as the storage cells that have been written with new pixel data. This information is used to read pixel data from the cache and to write to the SGRAM frame buffer 130 only the data that has changed.

A multiple format cache 500 as set forth in FIG. 8 using the storage cell 400 described with regard to FIG. 7 significantly improves performance of a graphics system. The use of the multi-format cache reduces read/write overhead by allowing single state, random access to all four pixels contained in a tile. Further, the dual input, dual output storage cell 400 greatly increases the circuit density over an implementation using external multiplexers, shown in FIG. 6, due to significantly reduced wiring overhead. Still further, the architecture of the cache is scalable and any reasonable pixel depth can be accommodated by simply adding or removing storage cells. Finally, performance and density are maintained regardless of the cache size.

While the storage element 400 is described as using an eight-bit latch 402 and input and output buses each of eight bits, any number of bits may be used. The width of these input and output buses and, accordingly, the width of the latch is dependent upon system architecture. It is clear that each of the buffers 408, 410, 420 and 422, although shown as single eight-bit devices, could each consist of multiple single bit devices. Additionally, the eight-bit latch 402 may be implemented with eight single-bit latches connected appropriately.

While various embodiments of the present invention have been described above, it should be understood that they have been presented by way of example only. Thus, the breadth and scope of the present invention are not limited by any of the above-described exemplary embodiments, but are defined only in accordance with the following claims and their equivalents.

What is claimed is:

1. A cache for storing data in first and second formats, comprising:

an array of storage elements including one or more tiles, each tile comprised of m rows and n columns of storage elements, each of said m rows of storage elements representing data having a first format, and each of said n columns of storage elements representing data having a second format different that said first format;

a first input bus, coupled to said storage elements of one of said tiles, for writing data in said first format into said n storage elements of a selected row of said tile;

a first output bus, coupled to said storage elements of said one of said tiles, for reading data from said n storage elements of said selected row of said tile to generate said data in said first format;

a second input, bus coupled to said storage elements of said one of said tiles, for writing data in said second format into said m storage elements of a selected column of said tile; and a second output bus, coupled to said storage elements of said one of said tiles for reading data from said m storage elements of said selected column of said tile to generate data in said second format.

2. The cache as defined in claim 1, wherein said data in said first format is pixel data and said data in said second format is frame buffer data.

3. The cache as defined in claim 1, wherein each of said storage elements comprises:

a latch having inputs and outputs, an input circuit for connecting said first input bus to the inputs of said latch and for connecting said second input bus to the inputs of said latch, and an output circuit for connecting the outputs of said latch to said first output bus and for connecting the outputs of said latch to said second output bus.

4. The cache as recited in claim 3, wherein each input circuit comprises:

a first input buffer having an input connected to the first input bus and an output connected to the latch inputs; and a second input buffer having an input connected to the second input bus and an output connected to the latch inputs.

5. The cache as recited in claim 4, wherein each storage element further comprises:

a first input buffer select line connected to the first input buffer;

a second input buffer select line connected to the second input buffer;

wherein, when the first input buffer select line is asserted, the first input bus is operatively coupled to the latch inputs; and wherein, when the second input buffer select line is asserted, the second input bus is operatively coupled to the latch inputs.

6. The cache as recited in claim 5, wherein the latch in each storage element is operatively coupled to the first and second input buffer select lines and is enabled when at least one of the first and second input buffer select lines is asserted.

7. The cache as recited in claim 6, wherein each storage element further comprises:

an OR-gate having first and second inputs connected, respectively, to the first and second input buffer select lines and an output connected to an enable input of the latch.

8. The cache as recited in claim 3, wherein each output circuit comprises:

a first output buffer having an input connected to the latch outputs and an output connected to the first output bus; and a second output buffer having an input connected to the latch outputs and an output connected to the second output bus.

9. The cache as recited in claim 8, wherein the first and second output buffers are each a tri-state device.

10. The cache as recited in claim 8, wherein each storage element further comprises:

a first output buffer select line connected to the first output buffer;

a second output buffer select line connected to the second output buffer;

wherein, when the first output buffer select line is asserted, the latch outputs are operatively coupled to the first output bus; and wherein, when the second output buffer select line is asserted, the latch outputs are operatively coupled to the second output bus.

11. A dual input, dual output n-bit storage cell having first and second input data buses and first and second output data buses, the storage cell comprising:

a latch having a latch input bus and a latch output bus;

a first input buffer connected between the first input data bus and the latch input bus to operatively couple the first input data bus to the latch input bus;

a second input buffer connected between the second input data bus and the latch input bus to operatively couple the second input data bus to the latch input bus;

a first output buffer connected between the latch output bus and the first output data bus to operatively couple the latch output bus to the first output data bus; and a second output buffer connected between the latch output bus and the second output data bus to operatively couple the latch output bus to the second output data bus;

an OR-gate having first and second inputs connected, respectively, to the first and second input buffer select lines and an output connected to an enable input of the latch, wherein the latch is enabled when at least one of the first and second input data buses is coupled to the latch.

12. The storage cell as recited in claim 11, wherein the first and second output buffers are each a tri-state buffer.

13. A graphics system for processing and storing data in a first format and a second format, the system comprising:

a memory for storing pixel data in the first format and frame buffer data in said second format, said memory including a bi-directional port;

a cache having storage elements arranged in m rows and n columns, for storing data in said first format in selected rows of said array of storage elements, and for storing data in said second format in selected columns of said array of storage elements; and a controller for coupling pixel data in said first format to and from said n storage elements of at least one selected row of said storage elements in said cache and for coupling frame buffer data in said second format to and from said m storage elements of at least one selected column of said storage elements from and to said memory through said bi-directional port.

14. The graphics system as recited in claim 13, wherein the memory is a single-port memory.

15. The graphics system as recited in claim 13, wherein the cache further comprises:

a first input bus coupled to said storage elements for coupling data in the first format into a selected row of said storage elements;

a first output bus coupled to said storage elements for coupling data in said first format from said selected row of said storage elements;

a second input bus coupled to said storage elements for coupling data in the second format into a selected column of said storage elements; and a second output bus coupled to said storage elements for coupling data in said second format from said selected column of said storage elements;

wherein said second input bus and said second output bus are each operatively coupled to the memory.

16. The graphics system as recited in claim 15, wherein each storage element in the array comprises:

a latch having inputs and outputs, an input circuit for connecting said first input bus to the inputs of said latch and for connecting said second input bus to the inputs of said latch, and an output circuit for connecting the outputs of said latch to said first output bus and for connecting the outputs of said latch to said second output bus.

17. The system as recited in claim 16, wherein each output circuit comprises:

a first output buffer having an input connected to the latch outputs and an output connected to the first output bus; and a second output buffer having an input connected to the latch outputs and an output connected to the second output bus.

18. The system as recited in claim 17, wherein in each storage element the first and second output buffers are each a tri-state device.

19. A method of storing and providing data in a first format and a second format different than the first format in an apparatus having a plurality of storage devices connected in an n row and m column configuration, each row of storage devices representing data having the first format, and each column of storage devices representing data having the second format, each storage device having first and second inputs connected, respectively, to first and second input buses and having first and second outputs connected, respectively, to first and second output buses, the method including the steps of:

(a) providing input data in the first format on the first input bus;

(b) storing a respective segment of the input data in a respective storage device in a selected row of the apparatus;

(c) repeating steps (a)–(b) for each row of storage devices; and (d) outputting to the second output bus the data in each of m storage devices in at least one column to generate data in said second format.

20. The method as recited in claim 19, including steps of:

(e) providing data in the second format on the second input bus;

(f) storing a respective segment of the input data in the second format in a respective m storage devices in a selected column;

(g) repeating steps (e) and (f) for each column of storage devices; and (h) outputting to the first output bus the data in each of n storage devices in at least one row to generate data in said first format.

21. The method as recited in claim 20, wherein each storage device comprises tri-state buffers connected to the first output bus.

22. The method as recited in claim 21, wherein the first outputs of the storage devices in each column are connected to one another; and the second outputs of the storage devices in each row are connected to one another.

23. A frame buffer assembly comprising:

a single port frame buffer, wherein said single port is utilized to render data to said frame buffer and for reading data for display from said frame buffer; and a dual port, multiple format frame buffer cache comprising, frame buffer data input and output ports coupled to said single port frame buffer for transferring data in a frame buffer format;

pixel data input and output ports for transferring data in a pixel data format;

an array of storage elements including one or more tiles, each tile comprised of m rows and n columns of storage elements, each of said n rows of storage elements representing data having a first format, and each of said m columns of storage elements representing data having a second format different that said first format;

a first input bus, coupled to said storage elements of one of said tiles, for writing data in said first format into said n storage elements of a selected row of said tile;

a first output bus, coupled to said storage elements of said one of said tiles, for reading data from said n storage elements of said selected row of said tile to generate said data in said first format;

a second input, bus coupled to said storage elements of said one of said tiles, for writing data in said second format into said m storage elements of a selected column of said tile; and a second output bus, coupled to said storage elements of said one of said tiles for reading data from said m storage elements of said selected column of said tile to generate data in said second format.

* * * * *